US008091464B1

(12) United States Patent
Imholt et al.

(10) Patent No.: US 8,091,464 B1
(45) Date of Patent: Jan. 10, 2012

(54) SHAPED CHARGE RESISTANT PROTECTIVE SHIELD

(75) Inventors: Timothy J. Imholt, Richardson, TX (US); Alexander F. St. Claire, Dallas, TX (US); Michael L. Noland, Dallas, TX (US)

(73) Assignee: Raytheon Company, Waltham, MA (US)

( * ) Notice: Subject to any disclaimer, the term of this patent is extended or adjusted under 35 U.S.C. 154(b) by 233 days.

(21) Appl. No.: 12/260,695

(22) Filed: Oct. 29, 2008

Related U.S. Application Data

(60) Provisional application No. 60/983,481, filed on Oct. 29, 2007, provisional application No. 61/049,688, filed on May 1, 2008.

(51) Int. Cl.
*F41H 5/02* (2006.01)

(52) U.S. Cl. ..... 89/36.02; 428/911; 109/49.5; 89/904

(58) Field of Classification Search ..... 89/36.02; 428/911; 109/49.5
See application file for complete search history.

(56) References Cited

U.S. PATENT DOCUMENTS

| | | | | |
|---|---|---|---|---|
| 4,545,286 | A * | 10/1985 | Fedij | 89/36.02 |
| 4,982,667 | A | 1/1991 | Weimann | |
| 5,429,031 | A * | 7/1995 | Merendino | 89/36.02 |
| 6,510,797 | B1 | 1/2003 | Fong | |
| 6,581,504 | B2 * | 6/2003 | Caron | 89/36.02 |
| 6,681,679 | B2 * | 1/2004 | Vives et al. | 89/36.17 |
| 6,834,593 | B2 | 12/2004 | Nardone et al. | |
| 7,150,235 | B1 | 12/2006 | Mikhail | |
| 7,322,267 | B1 * | 1/2008 | Munson, Jr. | 89/36.02 |
| 7,350,450 | B1 * | 4/2008 | Chu et al. | 89/36.02 |
| 7,546,795 | B1 * | 6/2009 | Munson, Jr. | 89/36.02 |
| 2009/0031889 | A1 | 2/2009 | Saul et al. | |
| 2009/0199701 | A1 * | 8/2009 | Wickert et al. | 89/36.02 |
| 2010/0107862 | A1 * | 5/2010 | Schulte | 89/36.02 |
| 2010/0206158 | A1 * | 8/2010 | Neethling | 89/36.02 |
| 2010/0282062 | A1 * | 11/2010 | Sane et al. | 89/36.02 |

* cited by examiner

*Primary Examiner* — Michael David
(74) *Attorney, Agent, or Firm* — Baker Botts L.L.P.

(57) ABSTRACT

In one embodiment, a protective armor system includes first and second armor layers separated by a gap. The second armor layer has a hardness that is less the first armor layer. The protective shield is configured to disperse energy of a shaped charge, such as the energy within a penetrator generated by an explosively formed penetrator (EFP).

24 Claims, 2 Drawing Sheets

SHAPED CHARGE RESISTANT PROTECTIVE SHIELD

RELATED APPLICATIONS

This application claims priority to U.S. Provisional Patent Application Ser. No. 60/983,481, entitled "PROTECTIVE SHIELD FOR A MILITARY VEHICLE," which was filed on Oct. 29, 2007, and U.S. Provisional Patent Application Ser. No. 61/049,688, entitled "SYSTEMS AND METHOD FOR MITIGATING EXPLOSIVELY FORMED PENETRATORS," which was filed on May 1, 2008.

TECHNICAL FIELD OF THE DISCLOSURE

This disclosure generally relates to protective armor, and more particularly to a protective shield for resisting impacts from shaped charges, such as explosively formed penetrators.

BACKGROUND OF THE DISCLOSURE

An explosively formed projectile (EFP) is a type of shaped charge designed to penetrate armor. Penetration of the armor may cause behind armor effects, such as spall. Spall is the armor fragments that break away from the armor of a vehicle as a result of penetration by an explosively formed projectile. These armor fragments may be extremely hot and may be accelerated to extremely high velocities. These fragments may damage equipment and may injure or kill personnel.

SUMMARY OF THE DISCLOSURE

In one embodiment, a protective armor system includes first and second armor layers separated by a gap. The second armor layer has a hardness that is less than the first armor layer. The protective shield is configured to disperse energy within a penetrator generated by a shaped charge, such as an explosively formed penetrator (EFP).

Some embodiments of the disclosure may provide numerous technical advantages. For example, one embodiment of the protective armor system may provide enhanced resistance by adding mass to the penetrator.

This added mass may decrease the energy of the penetrator, causing it to be less effective. Further technical advantages of particular embodiments of the present disclosure may include an armor system that is lighter weight than conventional armor. This lightweight armor system may be capable of protecting against a similar threat as a heavier conventional armor system.

Other technical advantages will be readily apparent to one of ordinary skill in the art from the following figures, descriptions, and claims. Moreover, while specific advantages have been enumerated above, various embodiments may include all, some, or none of the enumerated advantages.

BRIEF DESCRIPTION OF THE DRAWINGS

A more complete understanding of embodiments of the disclosure will be apparent from the detailed description taken in conjunction with the accompanying drawings in which.

DETAILED DESCRIPTION OF EXAMPLE EMBODIMENTS

Shaped charges, in particular explosively formed penetrators (EFPs), also referred to as explosively formed projectiles, may be a serious threat to equipment and personnel on the battlefield. Explosively formed penetrators may have the ability to pierce through the armor of a vehicle and injure or kill the occupants inside. When the armor is pierced by the explosively formed penetrator, spall may result. Spall refers to the fragments of armor that break off of the explosively formed penetrator and/or vehicle and accelerate into the interior of the vehicle. This material may be relatively hot and may move at a relatively high velocity. Thus, spall may be extremely dangerous or deadly to personnel and damaging to equipment.

Figure 1A:
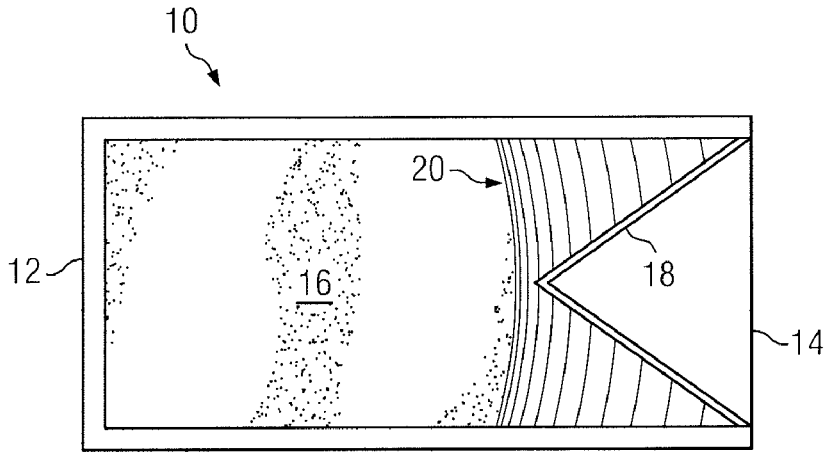
FIGS. 1A through 1C show several progressive stages of a shaped charge during detonation.
Figure 1B:
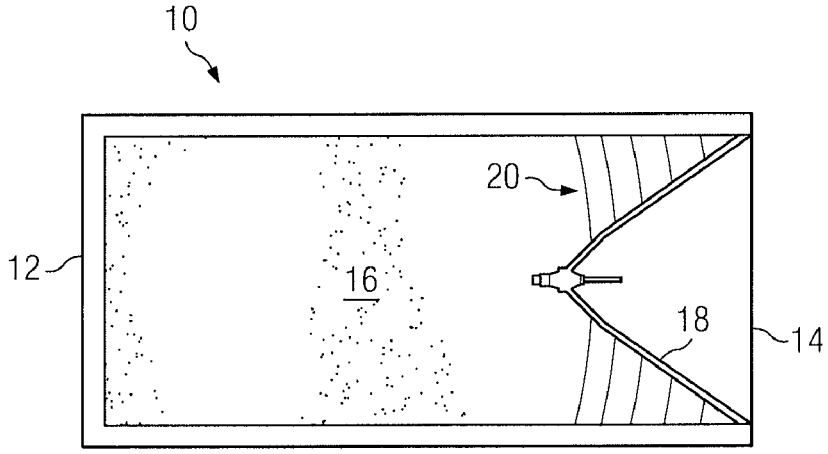
Figure 1C:
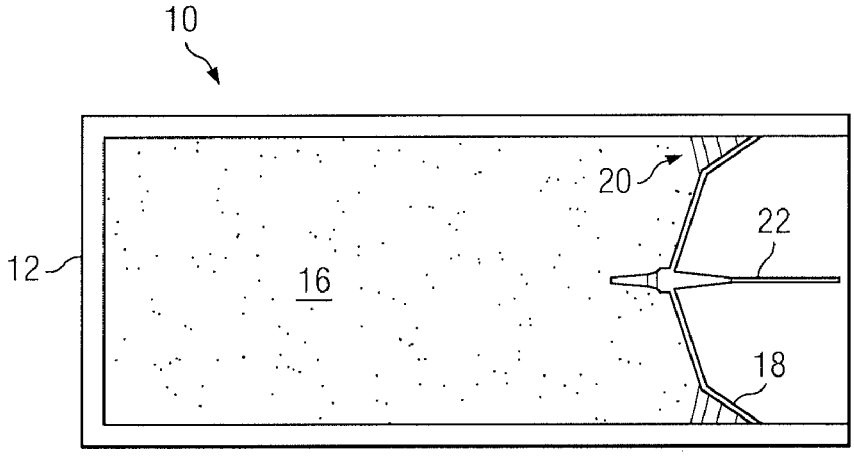

FIGS. 1A through 1C show several progressive stages of a shaped charge 10 during explosion. Shaped charge 10 includes a container 12 having an opening 14 with a high explosive (HE) region 16 and a metal liner 18 configured inside. High explosive region 16 stores a high explosive for generating a shock wave 20 during detonation. As shock wave 20 progresses towards opening 14, metal liner 18 behaves similar to a fluid to form a relatively thin penetrator 22 moving at hypervelocity. Generally, hypervelocity refers to projectiles moving at greater than 6,700 miles per hour.

High explosives may be extremely powerful because of their ability to rapidly release energy in the form of heat and pressurized gas. The extremely fast rate that this energy is discharged gives a high explosive its strength. When this energy is discharged, shock wave 20 is formed. The energy may compress the neighboring air or surrounding material and increase its velocity. This compressed air may then rapidly propagate toward opening 14 as a shock wave 20.

The geometry of metal liner 18 may yield a relatively powerful, focused blast. In the particular shaped charge 10 shown, metal liner 18 has a generally conical shape; however, other shaped charges may have metal liners with differing shapes, such as a semi-spherical shape. The metal liner 18 may be copper, or any other suitable metal that behaves similarly to a fluid when subjected to extremely high inertial forces.

There may be a wide range of explosively formed penetrator designs or other shaped charges, depending on the desired effect. In some instances, a shaped charge may be able to pierce a thickness of steel armor equal to the diameter of the charge. It may also be effective when fired at a target from a distance.

Shock wave 20 places inertial forces on metal liner 18 affect the molecular structure of its constituent material. Acceleration from rest to hypervelocity of metal liner 18 may be extremely high, thus generating extremely high inertial forces. These inertial forces may be significantly greater than the molecular forces holding metal liner 18 together. As a result, the material may behave similarly to a liquid with the dominating inertial forces guiding the flow of the material. Inertial forces causing a material to behave similar to a liquid is a basic principle of shaped charge's 10 operation. This principle may be exploited in accordance with a particular embodiment of the present disclosure to mitigate the damage caused by shaped charge 10.

As penetrator 22 penetrates armor, the armor may exert a drag force on the leading tip of penetrator 22. Since the penetrator 22 is fluid-like, the tip portion that is subjected to the drag force may fall away from the sides of the hole created in the armor. Secondly, only a small portion of penetrator 22 may experience drag, while the rest of penetrator 22 maintains its velocity as it travels through the hole in the armor.

Dragging only a portion of the metal tip may reshape the shaped charge into a better penetrator. The edges of the shaped charge may be somewhat consumed as they are pushed to the rear of the shaped charge yielding a thinner, more effective penetrator. In addition, the fluid-like shaped charge effectively lubricates the armor walls and slides through the hole in the armor.

Shaped charges may be capable of penetrating extremely thick and heavy armor. Therefore, merely adding more armor layers to protect against a shaped charge may result in a vehicle that is overweight and less effective on the battlefield. In accordance with a particular embodiment of the present disclosure, lightweight armor may be capable of stopping a shaped charge, such as an explosively formed penetrator, or significantly reducing its destructive capability.

Figure 2:
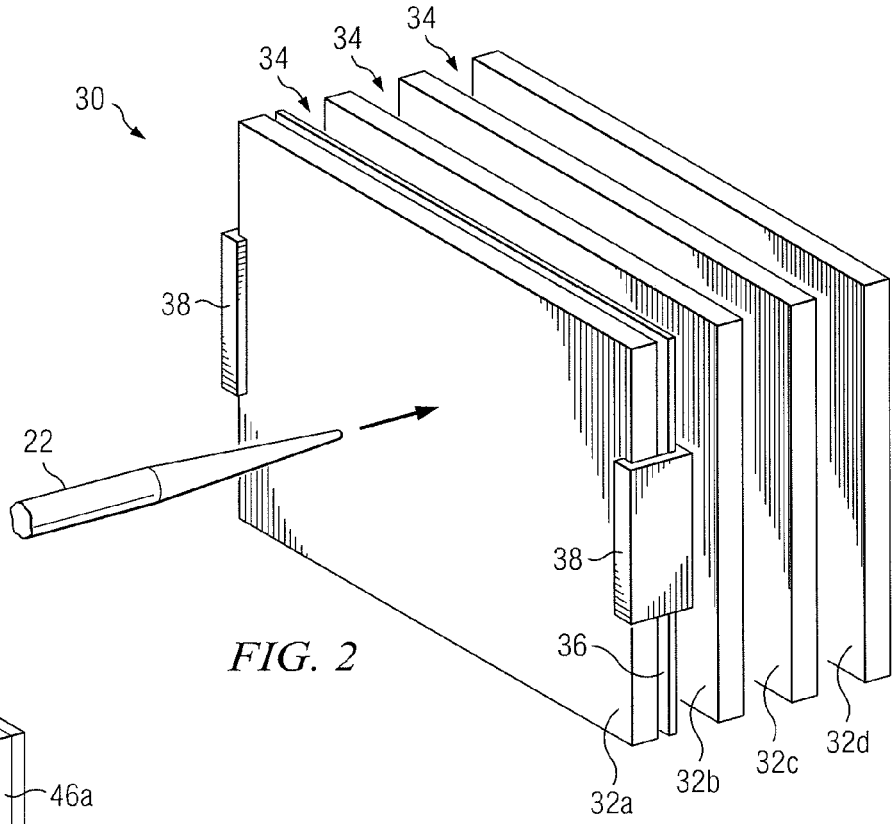
FIG. 2 is a perspective view of one embodiment of a protective shield according to the teachings of the present disclosure.

FIG. 2 shows one embodiment of a portion of a protective shield 30 that may provide protection from shaped charges 10 and other types of projectiles. Protective shield 30 includes multiple armor layers 32 separated from one another by gaps 34. Gaps 34 may include an intermediate layer 36 or other suitable material for attenuating the effects of a penetrator 22 from a shaped charge 10. In the particular embodiment shown, protective shield 30 includes two outer armor layers 32*a* and 32*d* and two inner armor layers 32*b* and 32*c* separated from one another by three gaps 34; however, protective shield 30 may have any suitable number of armor layers 32.

Protective shield 30 may form an outer portion of any suitable object in order to protect the object from penetrator 22 of explosively formed projectile 10. For example, protective shield 30 may form an outer portion of an armored vehicle, such as a tank, an armored personnel carrier, or any other armored vehicle used in military combat.

Armor layers 32 may have any suitable thickness. In one embodiment, an armor layer 32 may have a thickness in the range of approximately less than 0.50 inches, 0.50 to 0.75 inches, or greater than 0.75 inches. Armor layers 32 may be made of materials with a hardness that is similar to or different from each other. In one embodiment, outer armor layers 32*a* and 32*d* may be made of a relatively hard material, such as a ferrous alloy, and inner armor layers 32*b* and 32*c* may be made of a relatively softer material, such as a non-ferrous alloy having a Brinell hardness in the range of approximately 10 to 180 HB (brinell hardness). An example of a suitable hard material may include carbon steel alloy, while suitable softer materials may include an aluminum alloy and/or a magnesium alloy.

Armor layers 32 with differing hardnesses may provide enhanced protection from shaped charges 10 while being lighter in weight in some embodiments. For example, embodiments having a density of approximately 85 pounds per square foot (lbs/ft$^2$) may provide protection similar to that of known protective shields with a density of approximately 160 lbs/ft$^2$.

Gaps 34 may allow spreading of debris caused by the impact of penetrator 22 with armor layers 32 such that the energy of the impact may be dissipated over a relatively larger area. Thus, gaps 34 may dissipate energy in a relatively more efficient manner than protective shields with a homogeneous consistency. The width of gaps 34 may be similar to or different from one another. Gaps 34 may be up to 6 inches in width. In the particular embodiment shown, each of the gaps 34 is approximately 3 inches thick. Thus, the overall thickness of the protective shield 30 as shown may be approximately 14 to 16 inches thick.

In one embodiment, one or more gaps 34 are filled with a gaseous or liquid material for attenuating the effects of penetrator 22. For example, a gap 34 may be filled with a particular type of gas or liquid selected according to its intrinsic speed of sound, which may be different from that of air. Examples of fluids suitable for this purpose include a vacuum, radon, tungsten-hexafluoride, water, mineral oil, and ethylene-glycol. This aspect of the constituent gas or liquid may be operable to disrupt the path and/or energy of penetrator 22 traveling at hypervelocity through gap 34.

In another embodiment, one or more gaps 34 may be partially or fully filled with intermediate layer 36 that may include, for example, a composite material such a woven fabric and/or a ceramic material. An example of a suitable woven fabric includes a Nextel fabric material available from 3M CORPORATION, in St. Paul, Minn. Examples of suitable ceramic materials include titanium oxide and aluminum oxide.

In another embodiment, intermediate layer 36 may be a thin sheet of copper that is attached to the backside of an armor layer 32. The attachment may be such that intermediate layer 36 detaches and accelerates with penetrator 22 during movement through gap 34. When penetrator 22 imparts acceleration to intermediate layer 36, intermediate layer 36 may begin to flow like a fluid similar to the initial penetrator 22 formation from metal liner 18. Thus, the material of intermediate layer 36 may coat penetrator 22 and become an integral part of it. This process may be structurally similar to melting additional copper over penetrator 22 in order to increase its mass. By increasing the mass of penetrator 22, the velocity of penetrator 22 may be reduced due to conservation of momentum. In addition to increasing its mass, the surface area of penetrator 22 may also be increased. Penetrator 22 with increased surface area may have a less effective penetrating tip. Therefore, by adding material to penetrator 22, its energy may be reduced by slowing its velocity, and its penetrating effects may be reduced by increasing its surface area.

Intermediate layer 36 may be made from a wide variety of materials. Materials for intermediate layer 36 may be selected based on the fluid-like behavior that they exhibit when massive acceleration is applied in a similar manner to metal liner 18 becoming a fluid-like penetrator 22 during explosion of shaped charge 10. Suitable materials may include those that are used as metal liners in shaped charges. For example, copper may be an effective material in accordance with particular embodiments of the present disclosure.

Figure 4:
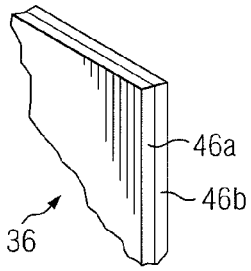
FIG. 4 is a perspective view of one embodiment of an intermediate layer of a protective shield according to the teachings of the present disclosure.

The thickness of intermediate layer 36 may also be selected such that it may adhere to penetrator 22. A thinner material may adhere to penetrator 22 better than a thicker material. For example an embodiment of intermediate layer 36 may include one or more layers 46*a* and 46*b* of copper foil (depicted in FIG. 4). By layering copper foil with small air gaps in between, the copper material may effectively coat penetrator 22 during movement through its respective gap 34. In one embodiment, suitable thicknesses of copper foil may range from 1 mil to 375 mils.

Intermediate layer 36 may be attached to its associated armor layer 32 by an adhesive. In alternative embodiments, intermediate layer 36 may be held in place by pegs, bolts, clips, clamps, rivets, adhesives, or any suitable fastening technique. An exemplary clip 38 is illustrated in FIG. 2. Regardless of the method to attach intermediate layer 36, the force required to detach the sheet may be less than the force required to penetrate the sheet. Thus, intermediate layer 36 may be detached from its associated armor layer 32 before it is pierced. Perforations in intermediate layer 36 may also allow it to be detached easier and may allow the detachment points to be finely controlled.

In one embodiment, intermediate layer 36 is preloaded with a spring loaded stress. A preloaded sheet may be a curved sheet that is elastically forced into a flat position when it is attached to armor layer 32. Once this sheet detaches as a result of the forces of penetrator 22, it may naturally conform to the shape of penetrator 22 and coat it. Thus, the natural springing force of the preloaded sheet may aid in shaping the material around penetrator 22 so that it may adhere better.

Figure 3:
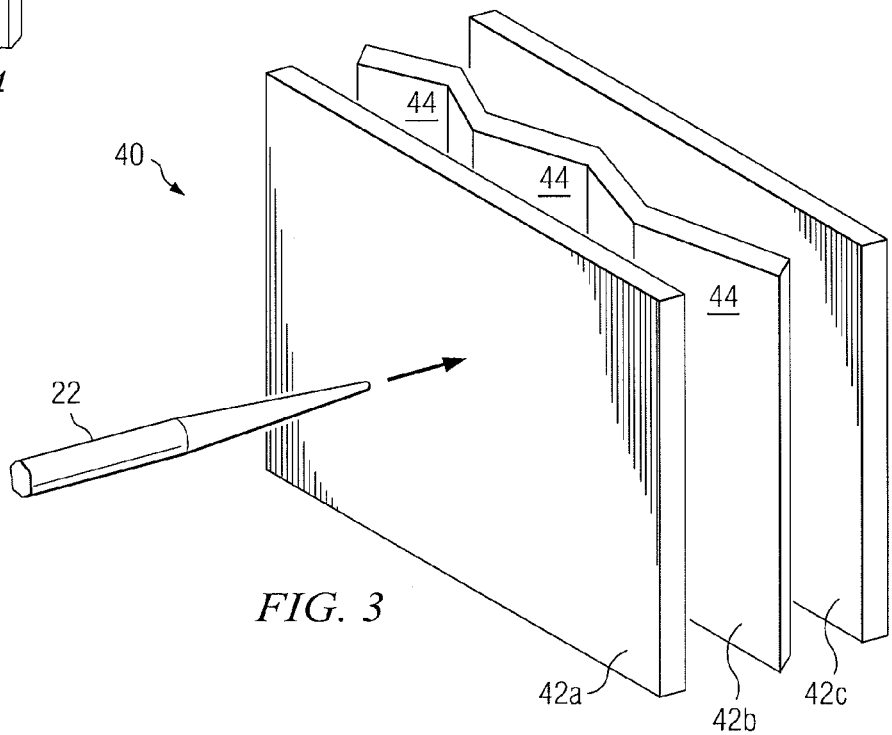
FIG. 3 is a perspective of another embodiment of a protective shield according to the teachings of the present disclosure.

FIG. 3 shows another embodiment of a protective shield 40 in which armor layers 42 may be configured obliquely with respect to one another. Protective shield 40 has outer armor layers 42*a* and 42*c* that are similar in design and construction to outer armor layers 32*a* and 32*d* of protective shield 30 as shown in FIG. 2. An inner armor layer 42*b* is bent at regular intervals along its extent. Thus, inner armor layer 42*b* forms contiguous segments 44 that are each obliquely oriented to outer armor layers 42*a* and 42*c*. During impact, the oblique orientation of segments 44 may divert penetrator 22 for further dissipating its energy in certain embodiments.

Although the present disclosure has been described with several embodiments, a myriad of changes, variations, alterations, transformations, and modifications may be suggested to one skilled in the art, and it is intended that the present disclosure encompass such changes, variations, alterations, transformation, and modifications as they fall within the scope of the appended claims.

What is claimed is:

1. A protective armor system comprising:

a protective shield configured to disperse kinetic energy of a penetrator generated by a shaped charge, the protective shield comprising:

a first armor layer configured to receive the penetrator;

a second armor layer separated from the first armor layer by a first gap, the second armor layer having a hardness that is less than the hardness of the first armor layer, the second armor layer configured to receive the penetrator that passes through the first armor layer; and an intermediate layer disposed in the first gap and attached to the first armor layer by a fastener, the fastener configured to release the intermediate layer such that the intermediate layer detaches from the first armor when the penetrator is received by the first armor layer, the intermediate layer configured to adhere to the penetrator as the penetrator passes through the gap, wherein, the force required to release the intermediate layer from the first armor layer is less than the force required to penetrate the first armor layer such that the fastener releases the intermediate layer from the first armor layer before the first armor layer is pierced by the penetrator.

2. The protective armor system of claim 1, wherein the intermediate layer comprises a plurality of copper foil sheets that are disposed adjacent one another.

3. The protective armor system of claim 1, wherein the intermediate layer comprises copper.

4. The protective armor system of claim 1, wherein the first armor layer comprises a ferrous alloy and the second armor layer comprises a non-ferrous alloy.

5. The protective armor system of claim 1, wherein a surface of the intermediate layer defines a plurality of perforations over its surface.

6. The protective armor system of claim 1, further comprising:

a third armor layer separated from the second armor layer by a second gap, the third armor layer having a hardness that is substantially the same as a hardness of the first armor layer, and wherein the first armor layer and the intermediate layer are disposed proximate a first side of the second armor layer and the third armor layer is disposed proximate a second side of the second armor layer.

7. The protective armor system of claim 6, wherein:

the first armor layer is composed of a first material;

the second armor layer is composed of a second material; and the third armor layer is composed of a third material.

8. The protective armor system of claim 1, wherein the intermediate layer is of a thickness between 1 mil and 375 mils.

9. A protective armor system comprising:

a protective shield configured to disperse kinetic energy of a penetrator generated by a shaped charge, the protective shield comprising:

a first armor layer configured to decelerate the penetrator;

an intermediate layer that is attached to the first armor layer by a fastener, the fastener configured to release the intermediate layer such that the intermediate layer detaches from the first armor layer when the penetrator is received by the first armor layer;

a second armor layer separated from the first armor layer by a first gap, the second armor layer having a hardness that is less than the hardness of the first armor layer, the second armor layer configured to decelerate the penetrator that pierces through the first armor layer; and a third armor layer separated from the second armor layer by a second gap, the third armor layer having a hardness that is substantially the same as the hardness of the first armor layer, wherein the first armor layer and the third armor layer are made of a first material and the second armor layer is made of a second material, wherein the second armor layer is disposed between the first armor layer and the third armor layer, and wherein the intermediate layer is configured to adhere to the penetrator as the penetrator passes through the first gap, wherein, the force required to release the intermediate layer from the first armor layer is less than the force required to penetrate the first armor layer such that the fastener releases the intermediate layer from the first armor layer before the first armor layer is pierced by the penetrator.

10. The protective armor system of claim 9, wherein the second gap has a different width than the first gap.

11. The protective armor system of claim 9, wherein the second armor layer comprises a non-ferrous alloy.

12. The protective armor system of claim 9, wherein the first armor layer comprises a ferrous alloy.

13. The protective armor system of claim 9, wherein the first gap is at least partially filled with a gas having an intrinsic speed of sound different from that of air.

14. The protective armor system of claim 9, wherein a surface of the intermediate layer defines a plurality of perforations over its surface.

15. The protective armor system of claim 9, wherein the intermediate layer is formed of a material selected from the group consisting of woven fabric, titanium oxide, and aluminum oxide.

16. The protective armor system of claim 9, wherein the second armor layer is disposed obliquely to the first armor layer.

17. A protective armor system, comprising:

a first armor layer configured to receive a penetrator generated by a shaped charge;

an intermediate layer attached to the first armor layer by a fastener, the intermediate layer having a thickness that is less than the first armor layer, the fastener configured to release the intermediate layer from the first armor layer when the penetrator is received by the first armor layer, the intermediate layer configured to adhere to the penetrator as the penetrator passes through a gap; and a second armor layer separated from the intermediate layer by a gap, the second armor layer configured to receive the penetrator that passes through the first armor layer and a portion of the intermediate layer detached from the armor layer, and wherein, the force required to release the intermediate layer from the first armor layer is less than the force required to penetrate the first armor layer such that the fastener releases the intermediate layer from the first armor layer before the first armor layer is pierced by the penetrator.

18. The protective armor system of claim 17, wherein the intermediate layer comprises a curved layer that is preloaded with a spring loaded stress.

19. The protective armor system of claim 17, wherein the intermediate layer comprises copper.

20. The protective armor system of claim 17, wherein the intermediate layer comprises a plurality of copper foil sheets that are disposed adjacent one another.

21. The protective armor system of claim 17, wherein a surface of the intermediate layer defines a plurality of perforations over its surface.

22. The protective armor system of claim 17, wherein the fastener selected from the group consisting of an adhesive, pegs, bolts, clips, and clamps.

23. The protective armor system of claim 17, wherein the first armor layer has a hardness that is greater than a hardness of the second armor layer.

24. The protective armor system of claim 17, wherein the first armor layer comprises a ferrous alloy and the second armor layer comprises a non-ferrous alloy.

* * * * *